US009723883B1

(12) United States Patent
Gharraee

(10) Patent No.: US 9,723,883 B1
(45) Date of Patent: Aug. 8, 2017

(54) SWEAT ABSORBER FOR ARMPITS

(71) Applicant: Zahra Gharraee, Modesto, CA (US)

(72) Inventor: Zahra Gharraee, Modesto, CA (US)

( * ) Notice: Subject to any disclaimer, the term of this patent is extended or adjusted under 35 U.S.C. 154(b) by 0 days.

(21) Appl. No.: 13/916,454

(22) Filed: Jun. 12, 2013

(51) Int. Cl.
*A41D 27/00* (2006.01)
*A41D 27/13* (2006.01)

(52) U.S. Cl.
CPC ..... *A41D 27/136* (2013.01); *A41D 27/133* (2013.01)

(58) Field of Classification Search
CPC .... A41D 27/13; A41D 27/133; A41D 27/136; A41D 27/12; A63F 13/15; A63F 13/56; A63F 13/62; A63F 13/64; A63F 13/84
USPC ..... 2/53, 55, 56, 57
See application file for complete search history.

(56) References Cited

U.S. PATENT DOCUMENTS

| | | | | | |
|---|---|---|---|---|---|
| 345,970 | A * | 7/1886 | Haskell | A41D 27/133 | 2/55 |
| 361,494 | A * | 4/1887 | Dewey | A41D 27/133 | 2/55 |
| 567,285 | A * | 9/1896 | Wormer | A41D 27/133 | 2/55 |
| 944,090 | A * | 12/1909 | Grund | A41D 27/133 | 2/55 |
| 1,122,113 | A * | 12/1914 | Hausner | | 2/55 |
| 1,127,093 | A * | 2/1915 | Ross | A41D 27/133 | 2/55 |
| 1,137,452 | A * | 4/1915 | Bienstock | | 2/55 |
| 1,348,754 | A * | 8/1920 | Shrader | | 2/55 |
| 1,641,004 | A * | 8/1927 | Mahoney | | 24/563 |
| 2,636,175 | A * | 4/1953 | Hoffman, Jr. | | 2/55 |
| 5,042,089 | A * | 8/1991 | Carmer | A41D 27/136 | 2/55 |
| 5,245,707 | A * | 9/1993 | Green | | 2/54 |
| 6,138,276 | A * | 10/2000 | Asciutto et al. | | 2/53 |
| 6,145,129 | A * | 11/2000 | Czekalla et al. | | 2/53 |
| 6,994,090 | B1 * | 2/2006 | Foster | | 128/845 |
| 8,938,812 | B1 * | 1/2015 | Gandy | | 2/55 |
| 2003/0167550 | A1 * | 9/2003 | Andrews | | 2/53 |
| 2006/0090239 | A1 * | 5/2006 | Koppen | A41D 27/136 | 2/53 |
| 2007/0067888 | A1 * | 3/2007 | Manier | | 2/53 |
| 2007/0174943 | A1 * | 8/2007 | Reeves | A41D 27/13 | 2/53 |

* cited by examiner

*Primary Examiner* — Khaled Annis
(74) *Attorney, Agent, or Firm* — Law Office of Rodney LeRoy

(57) ABSTRACT

A garment protector for protecting an outer garment from perspiration, body oils, and the like includes a chest strap configured to wrap around an upper part of a torso of a wearer adjacent to armpits of the wearer. The garment protector includes first and second absorbers attached to the strap and configured to be held at the armpits of the wearer by the strap. The under garment further includes a first arm strap attached to the first absorber and configured to wrap around a first arm of the wearer, and a second arm strap attached to the second absorber and configured to wrap around a second arm of the wearer.

12 Claims, 7 Drawing Sheets

SWEAT ABSORBER FOR ARMPITS

BACKGROUND OF THE INVENTION

The present invention relates generally to a garment protector. More particularly, the present invention relates to an under garment for collecting perspiration and inhibiting the perspiration from reaching an outer garment.

Garments are often a relatively large investment that individuals have a desire to protect from staining. Garments are often stained by body oils and perspiration that are exuded by a wearer. Garments are also often stained by cosmetics that wearers use, such as perfumes, lotions, deodorants, and antiperspirants. Once a garment is stained, cleaning the stain from the garment is often difficult or sometimes not possible. Therefore, such staining can undermine an investment in garments. Therefore, there is a need for products that protect garments from becoming stained and that protect an investment in garments.

BRIEF SUMMARY OF THE INVENTION

The present invention relates to an under garment that is configured protect an outer garment from perspiration, body oils, cosmetics, and the like.

According to one embodiment, a garment includes a strap configured to wrap around a torso of a wearer adjacent to armpits of the wearer. The garment further includes first and second absorbers attached to the strap and configured to be held at the armpits of the wearer by the strap. The garment further includes a first arm strap attached to the first absorber and configured to wrap around a first arm of the wearer. The garment further includes a second arm strap attached to the second absorber and configured to wrap around a second arm of the wearer.

According to a specific embodiment, the strap is configured to wrap substantially laterally across the wearer's chest and back. The strap may include a first connector device on a first end of the strap and a second connector device on a second end of the strap. The first connector device and the second connector device are configured to be connected to further connect the first end of the strap to the second end of the strap. The first and the second connectors may be configured to latch the first and the second ends of the strap together at the wearer's chest or back.

According to another specific embodiment, the first absorber and the second absorber are removably attached to the strap, and the first and the second arm straps are attached to the strap. The first absorber and the second absorber may be padded to provide comfort.

According to another embodiment, a garment includes first and second straps arranged in a figure-eight pattern and configured to wrap around a back and shoulders of a wearer adjacent to armpits of the wearer. The garment further includes a first absorber attached to the first strap and configured to be held at one of the armpits of the wearer by the first strap. The garment further includes a second absorber attached to the second strap and configured to be held at another of the armpits of the wearer by the second strap.

According to a specific embodiment, the first and the second straps are configured to cross at first and second crossing regions of the first and the second straps, respectively, and the first and second crossing regions are connected. The garment may also include a first arm strap attached to the first absorber and configured to wrap around a first arm of the wearer, and a second arm strap attached to the second absorber and configured to wrap around a second arm of the wearer.

Garment protector embodiments of the present invention provide protection for outer garments from becoming stained from body oil, perspiration, and cosmetics by providing a physical barrier between a person's armpits and the sleeves and body portions of garments that are held adjacent to a wearer's armpits while the garments are being worn. One specific benefit of the garment protector is the absorption of perspiration released from a wearer's armpits. By absorbing sweat, the garment protector, not only protects a wearer's outer garments from becoming stained, but also allows wearers to avoid the use of antiperspirants and deodorants, which can cause various detrimental reactions in the body, such a body rashes and the like. Further, by absorbing sweat, the garment protector can limit the body odor of a wearer and allow the wearer to maintain a sense of freshness while not wearing deodorants or antiperspirants.

Additional benefits and aspects of the embodiments of the invention will be set forth in part in the description that follows and the appended drawings.

DETAILED DESCRIPTION OF THE INVENTION

The present invention relates generally to a garment protector. More particularly, the present invention relates to an under garment for collecting perspiration and inhibiting the perspiration from reaching an outer garment.

Figure 1A:
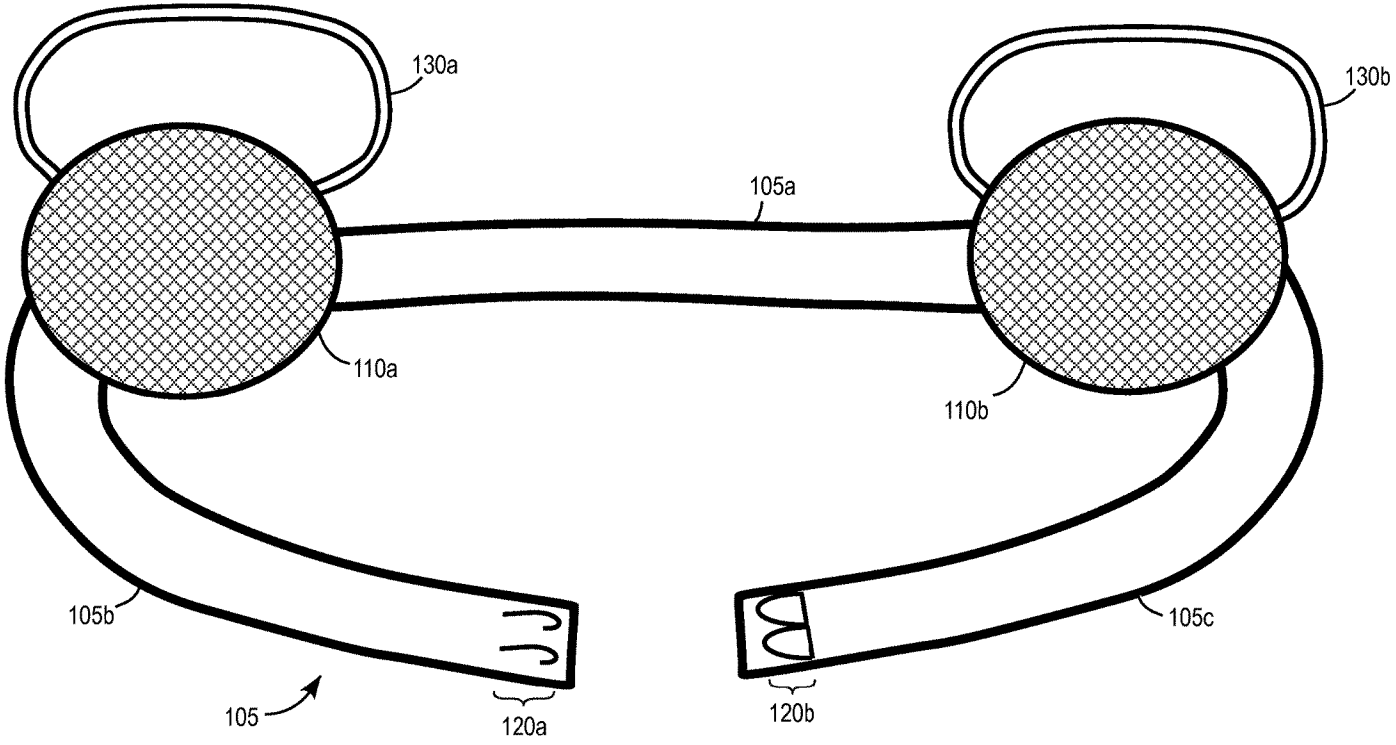
FIG. 1A is a simplified schematic of a garment protector according to one embodiment.

FIG. 1A is a simplified schematic of a garment protector 100 according to one embodiment. Garment protector 100 includes a strap 105, and absorbers 110*a* and 110*b*. Strap 105 (sometimes referred to as a chest strap) may include a first portion 105*a* that may be substantially continuous and connects to absorbers 110*a* and 110*b*. Strap 105 may include a second portion 105*b* and a third portion 105*c* that are configured to be connected by connection devices 120*a* and 1120*b*. Connection device 120*a* and 120*b* may include one or more of a variety of devices, such as hooks and eyelets, Velcro® of Velcro USA Inc. of Manchester N.H., snaps, clasps, magnets, or the like. While the second and third portions of strap 105 are shown as discontinuous, the second and third portions may be substantially continuous (e.g., similar to first portion 110*a*). The first, second, and third sections of strap 105 may be substantially continuous or may be separate pieces of strap material. Garment protector 100 may further include a first arm strap 130*a* that attaches to absorber 110*a*, strap 105, or both, and may include a second arm strap 130*b* that attaches to absorber 110*b*, strap 105, or both.

Figure 1B:
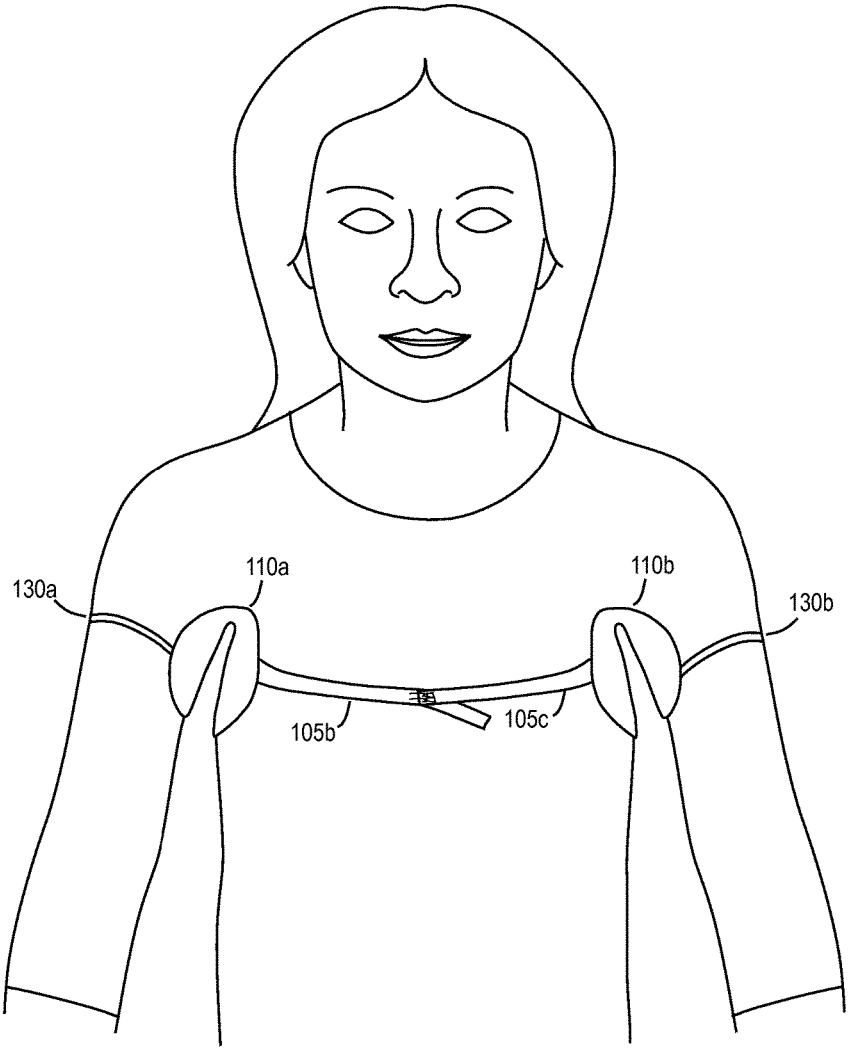
FIGS. 1B and 1C are a simplified front view and a simplified back view, respectively, of a wearer wearing the garment protector on the wearer's upper torso.
Figure 1C:
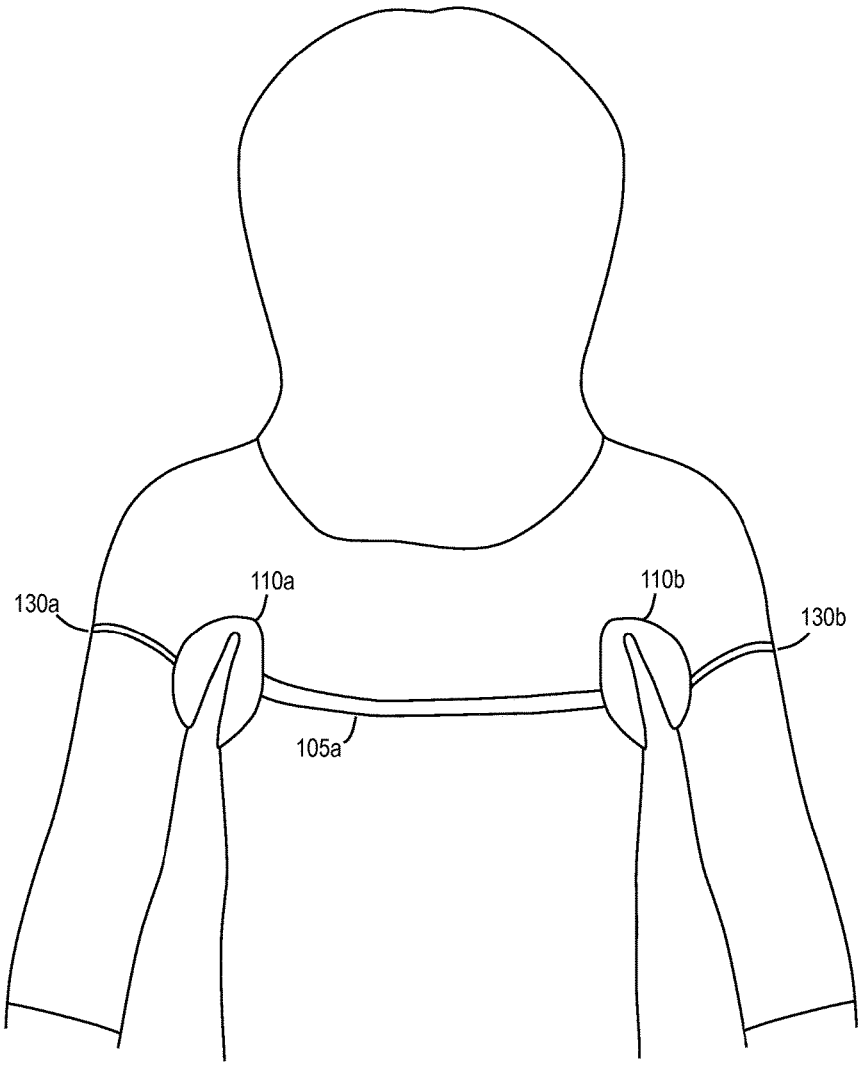

Garment protector 100 is an article of clothing (e.g., an under garment) that is configured to be worn on a wearer's upper torso and under the wearer's outer garments (e.g., shirt, blouse, jacket, sweater, or the like). FIGS. 1B and 1C are a simplified front view and a simplified back view, respectively, of a wearer wearing garment protector 100 on the wearer's upper torso.

As shown in FIGS. 1B and 1C, strap 105 is configured to wrap around the wearer's upper torso and hold absorbers 105*a* and 105*b* respectively under (e.g., against to) the wearer's armpits. Strap 105 may be configured to wrap substantially laterally across the wearer's chest (e.g., at the upper chest, such as at or above the wearer's pectorals) and upper back. Arm straps 130*a* and 130*b* are configured to respectively wrap around the wearer's upper arms (i.e., an arm portion between an elbow and a shoulder) and further hold absorbers 105*a* and 105*b* under the wearer's armpits.

FIG. 1B shows connection devices 120*a* and 120*b* connected at the front of a wearer's torso. However, the connection devices may be configured to connect at a wearer's back. According to an embodiment of garment protector 100 where the first portion 105*b* of strap 105 and the second portion 105*c* of strap 105 are substantially continuous (e.g., strap 105 does not include connection devices 120*a* and 120*b*), the wearer's head and shoulders may be placed through the strap to put the garment protector in place on the upper torso, or the wearer's legs and abdomen may be put through the strap to put the garment protector on the wearer's upper torso.

According to a further embodiment, first portion 105*b* of strap 105, second portion 105*c* of strap 105, or both may be configured to attach to a brassiere or the like that is worn by a wearer. For example, first portion 105*b*, second portion 105*c*, or both may include an attachment device configured to attach to a brassiere or like of the wearer. The attachment device may be: i) a pin, ii) Velcro® (or the like), iii) a hook that may hook to a bottom of a brassiere, such as around a bottom of a central portion of a brassiere between the cups, to a bottom of one or both of the cups, to the face of the cups, or the like, iv) a snap, v) a hook and eyelet, or the like. The attachment of strap 105 to a front portion of a brassiere at a wearer's chest holds the strap down so that the strap may not be visible in blouse with a relatively low neck line (e.g., such as v-neck opening, a scoop opening, or the like). According to one additional embodiment, first portion 105*b* and second portions 105*c* may be substantially long so that the first portion and the second portion can be attached to loop under a front portion of a brassiere of a wearer to hold the strap down so as not to be substantially visible in a blouse with a relatively low neck line.

Absorbers 105*a* and 105*b* and are configured to provide a physical barrier between the wearer's armpits and the sleeves and body portions of an outer garment that are held adjacent to the wearer's armpits while the outer garment is being worn by the wearer. Absorbers 105*a* and 105*b* may also provide a physical barrier between skin near the armpits and an outer garment. Absorbers 105*a* and 105*b* inhibit substances that may be on the wearer's armpits from contacting the person's outer garments. For example, absorbers 105*a* and 105*b* may inhibit body oils, perspiration, and cosmetics from contacting the wearer's outer garments, for example, via absorption.

Absorbers 105*a* and 105*b* may be padded for comfort, to provide further absorption capability, and to provide an air cushion between the user's armpits and an outer garment. Absorbers 105*a* and 105*b* may be made from a variety of material. For example, outer layers of absorbers 105*a* and 105*b* may be cotton, a cotton polyester blend, silk, microfiber, a microfiber blend, or the like. An inner portion of each absorber may be filled with batting, such as cotton batting, cotton-polyester batting, polyester batting, microfiber batting, or the like.

Absorbers 105*a* and 105*b* may be configured to be detached from strap 105 so that the absorbers may be changed and washed. Absorbers 105*a* and 105*b* may be attached to strap 105 by a variety of devices, such as snaps, Velcro®, pins, straps or loops in the absorbers through which strap 105 is fed, or the like.

Strap 105 may be configured to stretch along a length of the strap and may be configured to maintain a substantially fixed width. Being able to stretching along a length, strap 105 can stretch to a length that is comfortable for wearing around the wearer's upper torso and is substantially not binding on the wearer's skin and torso. With the strap configured to maintain a substantially fixed width while the strap is stretched along a length provides that the strap will not be narrowed so that the strap will not exert an uncomfortable amount of pressure on the wearer's skin. Strap 105 may have a variety of widths. For example, the width of strap may be about a half of an inch wide to about three inches wide.

Arms straps 130*a* and 130*b* may be configured to stretch along a length of the arm straps. Arms straps 130*a* and 130*b* may also be configured to extend at a variety of angles from absorbers 105*a* and 105*b*. For example, arm straps 130*a* and 130*b* may extend from absorbers 105*a* and 105*b* substantially horizontally to substantially vertically. For example, arm straps 130*a* and 130*b* may be configured to extend horizontally from absorbers 105*a* and 105*b* to wrap substantially horizontally across the wearer's upper arms. According to an alternative example, arm straps 130*a* and 130*b* may be configured to extend vertically from absorbers 105*a* and 105*b* such that the arms straps wrap substantially vertically across the wearer's shoulders.

Figure 2A:
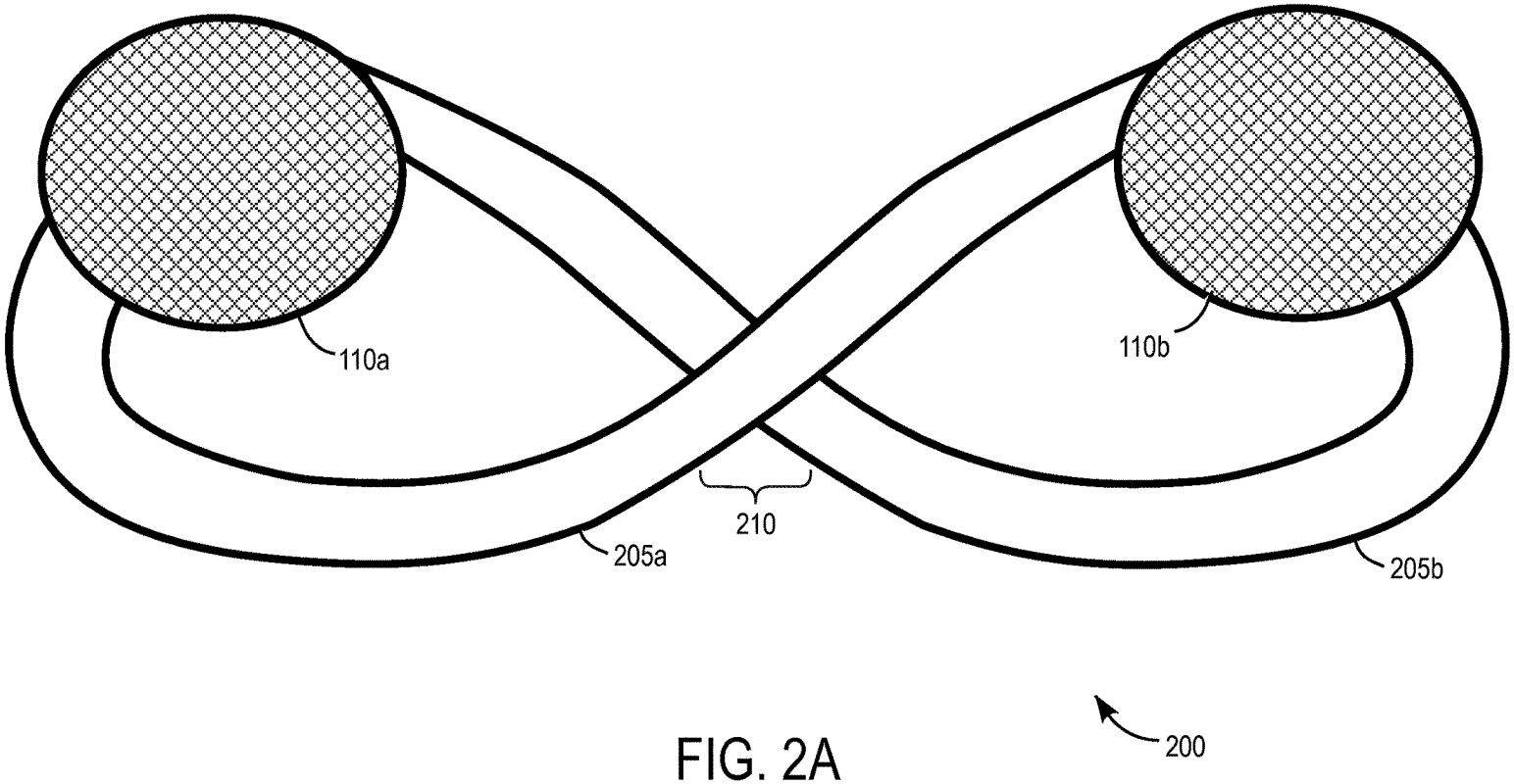
FIG. 2A is a simplified schematic of a garment protector according to an alternative embodiment.
Figure 2B:
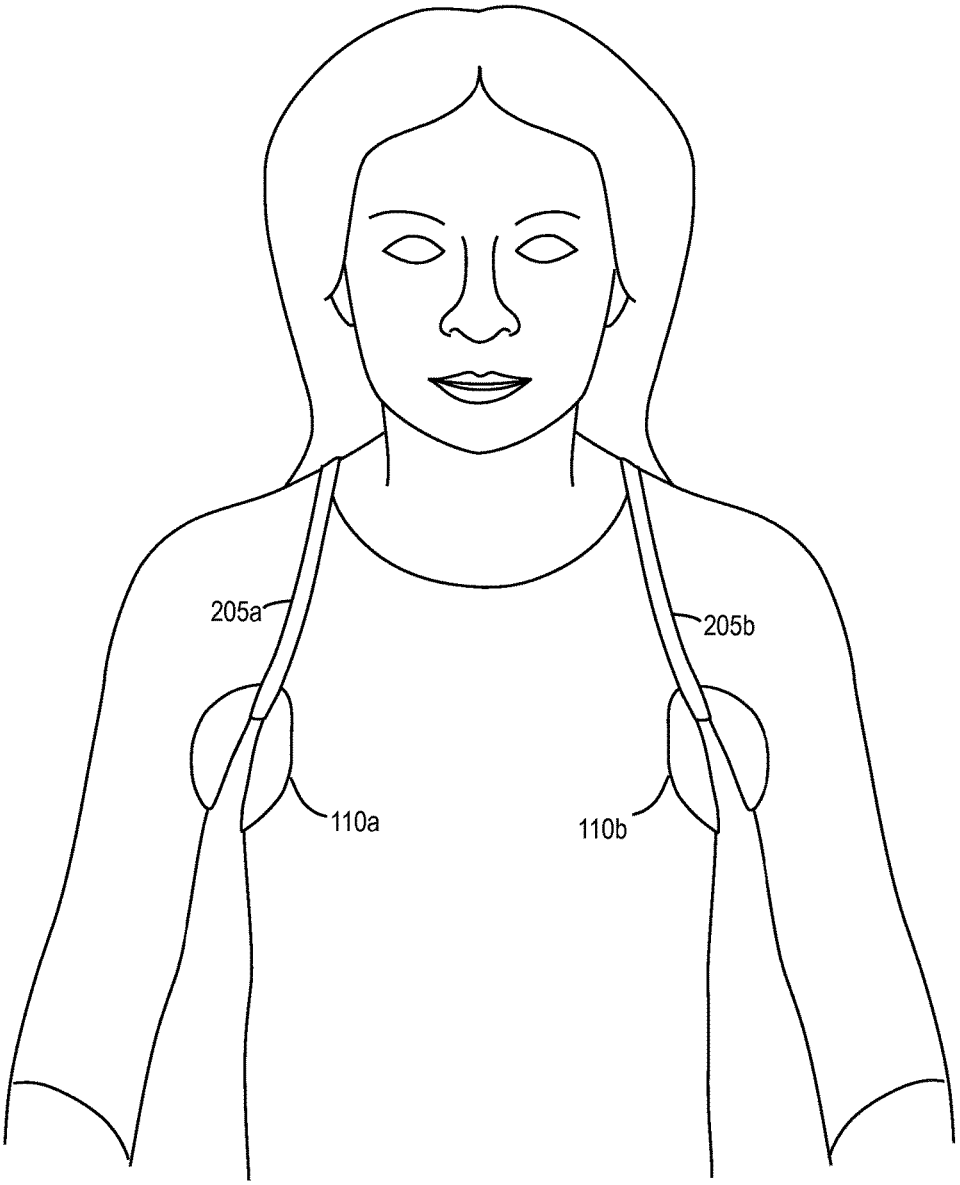
FIGS. 2B and 2C are a simplified front view and a simplified back view, respectively of a wearer wearing the garment protector of the alternative embodiment on the wearer's upper torso.
Figure 2C:
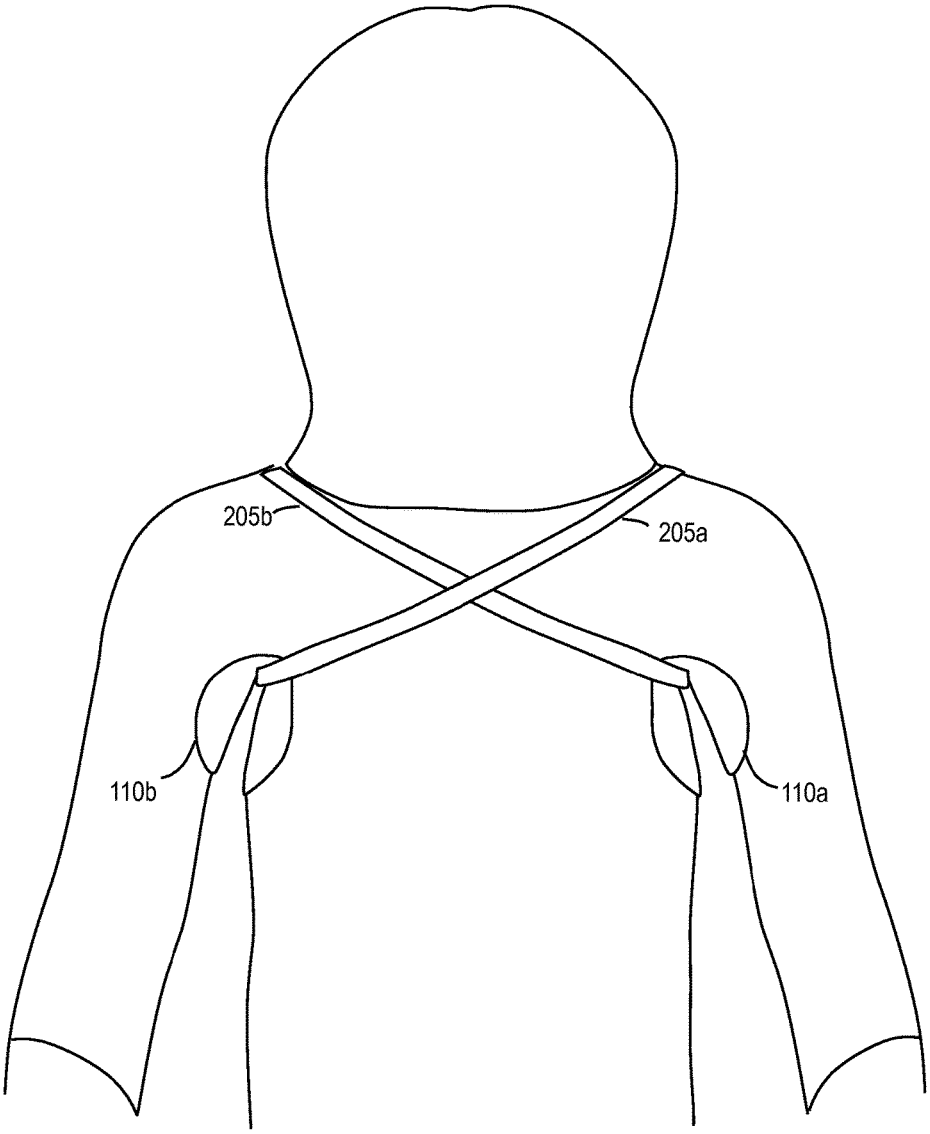

FIG. 2A is a simplified schematic of a garment protector 200 according to another embodiment. Garment protector 200 is substantially similar to garment protector 100 but differs from garment protector 100 in that garment protector 200 includes a first strap 205*a* and a second strap 205*b* that are configured in a figure-eight type pattern. FIGS. 2B and 2C are a simplified front view and a simplified back view, respectively, of garment protector 200 of a wearer wearing the garment protector on the wearer's upper torso. In the back view shown in FIG. 2C, first and second straps 205*a* and 205*b* are shown as crossing at the user's back. While FIG. 2C shows the first and second straps 205*a* and 205*b* crossing at the user's back, these straps may be configured to cross at the user's chest. As further shown in FIGS. 2B and 2C, first and second straps 205*a* and 205*b* may be configured to pass over a wearer's shoulders. With the straps over the wearer's shoulders, an upward force is created by the straps on absorbers 110*a* and 110*b* such that the absorbers are held upward against the wearer's armpits.

The first and second straps may be connected at a location 210 where the straps cross. The straps might be sewn together or otherwise connected at location 210.

Figure 2D:
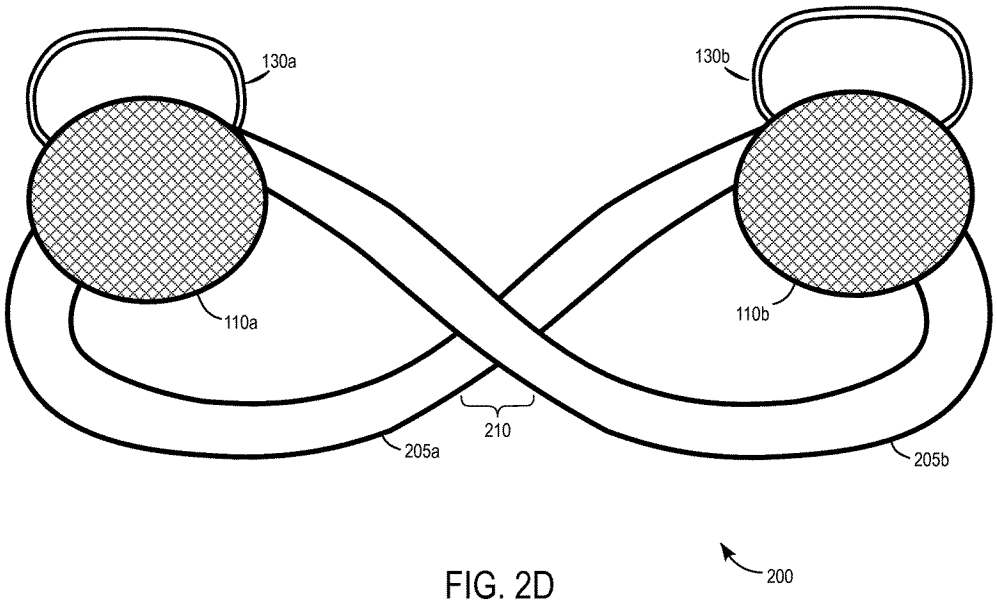
FIG. 2D is a simplified front view of a garment protector according to another alternative embodiment.

FIG. 2D is a simplified front view of a garment protector 200' according to one alternative embodiment. Garment protector 200' is substantially similar to garment protector 200 shown in FIGS. 2A-2C, but differs in that garment protector 200' includes arm straps 130*a* and 130*b*.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A garment comprising:

first and second straps arranged in a figure-eight pattern and configured to wrap around a back and shoulders of a wearer adjacent to armpits of the wearer;

a first absorber attached to the first strap and the second strap and configured to be held at a first armpit of the wearer by the first strap, wherein the first absorber comprises:

a first absorbent outer layer adapted to absorb perspiration of a wearer; and a first absorbent fill material, positioned inside of an inner portion of the first absorbent outer layer and filling the inner portion of the inside of the first absorbent outer layer, adapted to absorb the perspiration from the first absorbent outer layer into the inner portion of the inside of the first absorbent outer layer and into the first absorbent fill material; and a second absorber attached to the first strap and the second strap and configured to be held at a second armpit of the wearer by the second strap, wherein the first strap is adapted to extend from the first absorber at the first armpit of the wearer, from the first armpit up a first side portion of the chest of the wearer, from the first side portion of the chest over the first shoulder of the wearer, from the first shoulder of the wearer across the back of the wearer at a first angle with respect to the first shoulder, and attach to the second absorber at the second armpit of the wearer, the second strap is adapted to extend from the second absorber at the second armpit of the wearer, from the second armpit up a second side portion of the chest of the wearer, from the second side portion of the chest over the second shoulder of the wearer, from the second shoulder of the wearer across the back of the wearer at a second angle with respect to the second shoulder, and attach to the first absorber at the first armpit of the wearer, the second absorber comprises:

a second absorbent outer layer adapted to absorb perspiration of a wearer; and a second absorbent fill material, positioned inside of an inner portion of the second absorbent outer layer and filling the inner portion of the inside of the second absorbent outer layer, adapted to absorb the perspiration from the second absorbent outer layer into the inner portion of the inside of the second absorbent outer layer and into the second absorbent fill material.

2. The garment of claim 1 further comprising:

a first arm strap attached to the first absorber and configured to wrap around a first arm of the wearer; and a second arm strap attached to the second absorber and configured to wrap around a second arm of the wearer.

3. The garment of claim 2 wherein:

the first arm strap is connected to the first strap; and the second arm strap is connected to the second strap.

4. The garment of claim 1 wherein:

the first and the second straps are configured to cross at first and second crossing regions of the first and the second straps, respectively, and the first and second crossing regions are connected.

5. The garment of claim 1 wherein:

the first absorber is removably attached to the first strap, and the second absorber is removably attached to the second strap.

6. The garment of claim 1 wherein the first absorber and the second absorber are padded and formed of non-synthetic fiber material and not formed from a synthetic material.

7. The garment of claim 1 further comprising:

a first arm strap attached to the first absorber; and a second arm strap attached to the second absorber.

8. A garment comprising:

a first strap;

a second strap, wherein the first and second straps are arranged in a figure-eight pattern and configured to wrap around a back and shoulders of a wearer adjacent to armpits of the wearer;

a first absorber attached to the first strap and the second strap and configured to be held at a first armpit of the wearer by the first strap, wherein the first absorber comprises:

a first absorbent outer layer adapted to absorb perspiration of a wearer; and a first absorbent fill material, positioned inside of an inner portion of the first absorbent outer layer and filling the inner portion of the inside of the first absorbent outer layer, adapted to absorb the perspiration from the first absorbent outer layer into the inner portion of the inside of the first absorbent outer layer and into the first absorbent fill material;

a second absorber attached to the first strap and the second strap and configured to be held at a second armpit of the wearer by the second strap, wherein the first strap is adapted to extend from the first absorber at the first armpit of the wearer, from the first armpit up a first side portion of the chest of the wearer, from the first side portion of the chest over the first shoulder of the wearer, from the first shoulder of the wearer across the back of the wearer at a non-zero first angle with respect to the first shoulder, and attach to the second absorber at the second armpit of the wearer, the second strap is adapted to extend from the second absorber at the second armpit of the wearer, from the second armpit up a second side portion of the chest of the wearer, from the second side portion of the chest over the second shoulder of the wearer, from the second shoulder of the wearer across the back of the wearer at a non-zero second angle, and attach to the first absorber at the first armpit of the wearer, and the second absorber comprises:

a second absorbent outer layer adapted to absorb perspiration of a wearer; and a second absorbent fill material, positioned inside of an inner portion of the second absorbent outer layer and filling the inner portion of the inside of the second absorbent outer layer, adapted to absorb the perspiration from the second absorbent outer layer into the inner portion of the inside of the second absorbent outer layer and into the second absorbent fill material;

a first arm strap attached to the first absorber and the first strap, adapted to wrap around a first arm of the wearer; and a second arm strap attached to the second absorber and the second strap, adapted to wrap around a second arm of the wearer.

9. The garment of claim 8 wherein:

the first and the second straps are configured to cross at first and second crossing regions of the first and the second straps, respectively, and the first and second crossing regions are connected.

10. The garment of claim 9 wherein:

the first absorber is removably attached to the first strap and formed of non-synthetic fiber material and not formed from a synthetic material, and the second absorber is removably attached to the second strap and formed of non-synthetic fiber material and not formed from a synthetic material.

11. The garment of claim 8 wherein:

the first arm strap is connected to the first strap; and the second arm strap is connected to the second strap.

12. The garment of claim 1 wherein the non-zero first angle and the non-zero second angle have substantially equal magnitude.

* * * * *